United States Patent [19]

Fujita et al.

[11] 4,273,577

[45] Jun. 16, 1981

[54] BLAST-FURNACE OPERATION METHOD

[75] Inventors: Isao Fujita, Takarazuka; Nobuyuki Imanishi, Kobe; Tadao Tsutaya, Kobe; Ryo Watanabe, Kobe; Takao Kawai, Kobe, all of Japan

[73] Assignee: Kobe Steel, Limited, Kobe, Japan

[21] Appl. No.: 68,582

[22] Filed: Aug. 22, 1979

[30] Foreign Application Priority Data

Aug. 28, 1978 [JP] Japan ..... 53-104558

[51] Int. Cl.[3] ..... C21B 5/00

[52] U.S. Cl. ..... 75/41

[58] Field of Search ..... 75/41, 42

[56] References Cited

U.S. PATENT DOCUMENTS 3,581,070 5/1971 Tsujihata ..... 75/41

*Primary Examiner*—Melvyn J. Andrews

*Attorney, Agent, or Firm*—Oblon, Fisher, Spivak, McClelland & Maier

[57] ABSTRACT

The present invention discloses a blast-furnace operation method which comprises selecting three factors, i.e. the oxygen volume in blast, the ore/coke and the reducibility of the burden materials as control factors from among these which participate in the variation of heat input and heat output of blast furnace, plotting values of these three factors obtained from the practical operation of efficient blast furnaces on a graph consisting of three parallel axes indicating the three factors, evaluating the conditions of furnace heat with reference to a balanced state of the three plotted factors and adjusting one or more of the three factors in the furnace so all will lie within a suitable range thereby balancing the furnace heat.

9 Claims, 10 Drawing Figures

| | θ | P | C | F |
|---|---|---|---|---|
| (1975) JULY | 275 | 1.61 | 446 | 503 |
| AUG | 265 | 1.88 | 439 | 495 |
| OCT | 254 | 2.00 | 423 | 470 |
| DEC | 244 | 2.03 | 414 | 460 |
| (1976) FEB | 230 | 2.10 | 399 | 452 |

P: PRODUCTIVITY ($ton/m^3/day$)
C: COKE RATE (kg/t-pig)
F: FUEL RATE (kg/t-pig)

BLAST-FURNACE OPERATION METHOD

BACKGROUND OF THE INVENTION

1. Field of the Invention

The present invention relates to a blast-furnace operation method, and more specifically to a method of stably operating a blast furnace without causing the furnace to be out of condition i.e. normal operating parameters, and preventing furnace accident by quickly and properly controlling the thermal balance in the furnace.

2. Description of the Prior Art

Ores and coke are alternately introduced in the form of layers into a blast furnace through the top of the furnace, while the high-temperature air is introduced through tuyeres located at a lower portion of the furnace. The coke in the vicinity of the tuyere burns owing to the high-temperature air being introduced, producing reducing gas (CO) and heat, which rises toward the top of the furnace. The burden materials from the top of the furnace come into contact with the high-temperature reducing gas in a counter-current manner, descend while exchanging the heat and undergoing reduction melt, separate into pig iron and slag in the bottom of the furnace, and accumulate in a hearth.

The reduction reaction of the burden materials proceeds nearly over the whole area of the blast furnace in the direction of its height. However, the mode of the reducing reaction differs in various portions of the furnace, i.e. in a low-temperature zone at a relatively higher portion of the furnace and a high-temperature zone in the lower portion of the furnace there develop characteristic differences in the amount of the heat required for the reactions and in the amount of a reducing agent, i.e. carbon supply such as coke required. In the upper portion of the furnace where temperatures are less than about 1000° C., the iron oxide is reduced through the exothermic reaction represented by the following formula, $$FeOx + nCO \rightarrow Fe + xCO_2 + (n-x)CO \quad [I]$$

This reaction mechanism is called the indirect reduction reaction. To cause this the reaction to proceed efficiently, it is necessary to supply an excess of CO gas so that $CO_2$, which is a reaction product, is maintained at a value smaller than the value derived from the equilibrium relationship. Usually, n in the above formula [I] must be greater than 3. Therefore, to reduce one mole of FeO to Fe, more than 3 moles of a reducing agent are required.

In the high-temperature zone at the lower portion of the furnace, the two reactions proceed simultaneously as represented by the following formulas, $$FeO + CO \rightarrow Fe + CO_2 \quad [II]$$

$$C + CO_2 \rightarrow 2CO \quad [III]$$

As presented by the following formula, however, the above reactions apparently acquire an additional mechanism which is direct reduction by the solid carbon. This reaction is called the direct reduction reaction.

$$FeO + C \rightarrow Fe + CO \quad [IV]$$

The reduction of the molten FeO with the solid carbon at the lower portion of the furnace is also represented by the formula [IV]. The direct reduction reaction absorbs very great amounts of heat. To cause the reaction to proceed efficiently, therefore, it is necessary to operate supplemental heat. Accordingly, if the direct reduction reaction becomes excessive, fuel is required in amounts greater than that used as a reducing agent, so that the fuel consumption rate (hereinafter fuel rate) is increased.

Thus, the indirect reduction reaction [I] and the direct reduction reaction [IV] in the blast furnace are greatly different from each other in regard to thermal behaviour, and the reaction quantity ratio between the two reactions (hereinafter referred to as "direct reduction ratio") greatly affects the condition of the furnace heat causing the fuel rate to be considerably changed. The fuel rate changes depending upon the direct reduction ratio, e.g. when the direct reduction ratio is adjusted to a predetermined value, the sum of carbon that serves as the reducing agent and carbon that serves as a source of heat becomes minimal, enabling the operation to be carried out at a low fuel rate.

The blast furnace which is stably operated at a low fuel rate represents a state of operation in which the heat consumed in the furnace is neither excessive nor insufficient, and the reduction is efficiently carried out. In other words, the stability and the fuel rate of the blast furnace are strongly affected by the direct reduction ratio. When the direct reduction ratio is too small, the operation is carried out with the furnace being excessively heated; therefore, the furnace condition becomes unstable due to the excess amount of the heat required, and the fuel rate becomes high. Conversely, when the direct reduction ratio is too great, the furnace heat becomes too small. Therefore, the furnace condition becomes unstable, and an increased amount of the fuel is required to supplement the heat, eventually resulting in an increased fuel rate.

The abovementioned unstable furnace conditions cause not only the fuel rate to be increased and the operation efficiency correspondingly decreased, but also invites frequent occurrence of such accidents as overheat or lack of heat, causing the operation to be temporarily interrupted. To prevent such inconvenience, the direct reduction ratio in the furnace must be suitably controlled to maintain a constant heat balance so that the furnace heat does not become excessive or in short supply.

To strictly determine whether the heat in the blast furnace is excessive or in short supply, it is necessary to calculate the heat balance by taking into consideration all of the items related to the heat input and heat output of the blast furnace. Since the calculation is very complicated, a large computer has recently been put into practical use. However, when the direct reduction ratio is either extremely small or great, the reaction in the furnace is in an unsteady state, making it extremely difficult to correctly calculate the heat balance. Consequently, the furnace condition often becomes out of balance, presenting such serious problems as overheat or lack of heat. A great deal of research was required before the blast furnace could be completely controlled and these problems resolved.

In order to solve the abovementioned problems, the inventors have found thre principal factors which cause the heat input and heat output of the furnace to vary, i.e., the reducibility of the charged ores, the rate of the ores to the coke and the oxygen volume in blast. It has been found in accordance with the invention that the heat balance in the furnace can be accurately predicted based upon these three factors and that proper decisions regarding the condition of the furnaces can be rendered relying upon the relations among these factors.

SUMMARY OF THE INVENTION

Briefly, a principal object of the present invention is to eliminate the aforementioned problems inherent in the conventional blast furnaces.

An first object of the present invention, therefore, is to provide a blast-furnace operation method which is highly practicable in maintaining a suitable heat balance by quickly and properly judging the conditions of the furnace.

Another object of the present invention is to provide a blast-furnace operation method which is capable of positively controlling the factors which cause the furnace heat to vary, in order to smoothly and stably perform the operation of the blast furnace.

In order to achieve the abovementioned objects, a first embodiment of the present invention is related to a blast-furnace operation method which deals with control factors of the oxygen volume (X) in blast, the ore/coke ratio (Y), and the reducibility (Z) of the burden materials among factors which affect the variation of heat input and heat output of the blast furnace;

The relationship of the above-mentioned three factors is plotted on a graph having an axis (Y axis) which represents the ore/coke located at the center, an axis (X axis) which represents the oxygen volume in blast and an axis (Z axis) which represents the reducibility of the burden materials located on the left and right sides of the Y axis in parallel with each other. Values of the three factors obtained from the data of the practical operation of a conventional low-fuel-rate blast furnace are plotted on the graph, and an angle $\theta$ downwardly subtended on the central axis by two straight lines drawn from the two points on each of the neighboring axes is given by, $$\theta = 180° + \theta_x + \theta_z \text{ tm} \quad (1)$$

and at least one factor among the three factors is controlled relying upon a relation, $$\theta_x + \theta_z = \tan^{-1} f(X, Y) + \tan^{-1} g(Y, Z) \quad (2)$$

wherein $\theta_x$ and $\theta_z$ represent angles subtended toward the side of X axis and toward the side of Z axis with respect to a straight line drawn at right angles with the three axes passing through a value Y when the three factors are practically operating at values X, Y and Z; f(X, Y) represents a function of X and Y determined by a regression equation of X-Y obtained from the practical values of a conventional low-fuel-rate blast furnace in practical operation and a distance between the X and Y axes; and g(Y, Z) represents a function of Y and Z determined by a regression equation of Y-Z obtained from the practical values of a conventional low-fuel-rate blast furnace in practical operation and a distance between the Y and Z axes.

A second embodiment of the invention relates to a blast-furnace operation method in accordance the first embodiment, wherein the equation (2) is given by, $$\theta_x + \theta_z = \tan^{-1}\left(\frac{a_1X - Y + b_1}{e_1}\right) + \tan^{-1}\left(\frac{a_2Z - Y + b_2}{e_2}\right) \quad (3)$$

wherein $a_i$ (i=1, 2) represents a coefficient (gradient) of the regression equations of X-Y and Y-Z, $b_i$ (i=1, 2) represents a constant of the regression equations of X-Y and Y-Z, and $e_i$(i=1, 2) represents a constant determined by a distance between the axes X-Y and a distance between the axes Y-Z.

A third embodiment of the invention relates to a blast-furnace operation method in accordance with the first embodiment, wherein the distances among each of the three parallel axes of a graph indicating the three factors are either equally set or arbitrarily set, average values of the three factors obtained from the practical values of a conventional low-fuel-rate blast furnace in practical operation are so disposed on the graph as to serve as references of the same level on the three axes, a ratio of unit graduate widths of the three axes is determined from the coefficients (gradients) of the following regression formulas obtained from the practical values, $$Y = a_1X + b_1 \quad (4)$$

$$Y = a_2Z + b_2 \quad (5)$$

and the distances among each of the axes are set with reference to a graduate width of one axis selected from the three axes wherein the equation (4) is a regression equation of X-Y, and the equation (5) is a regression equation of Y-Z.

A fourth embodiment of the invention relates to a blast-furnace operation method in accordance with the third embodiment, wherein the ratio of unit graduate widths of the axes X, Y, and Z is set to be $X:Y:Z = a_1:1:a_2$.

A fifth embodiment of the invention relates to a blast-furnace operation method in accordance with the third embodiment, wherein the distance between the X axis and the Y axis, and the distance between the Y axis and the Z axis are, respectively, are set to be $e_1$ times and $e_2$ times a length corresponding to the unit graduate width of the Y axis, wherein $e_i$ (i=1, 2) represents a constant.

A sixth embodiment of the invention, relates to a blast-furnace operation method in accordance with the fifth embodiment, wherein $e_i$ (i=1, 2)=0.3 to 1.0.

A seventh embodiment of the invention relates to a blast-furnace operation method in accordance with the third embodiment, wherein the X axis and the Z axis are located on the left and right sides of the Y axis maintaining an equal distance, among them, the ratio of unit graduate widths of the axes X, Y and Z is set to be $X:Y:Z = a_1:1:a_2$, and the distance between the X axis and the Y axis and the distance beween the Y axis and the Z axis are set to be e times of a length corresponding to a unit graduate width of the Y axis, wherein e is a constant, i.e., $e = e_1 = e_2$.

An eighth embodiment of the invention relates to a blast-furnace opeation method in accordance with the seventh embodiment, wherein the ratio of unit graduate widths of the axes X, Y and Z is set to be X:Y:Z=1.25:1.0.063, and the distances between each of the axes are set to be 0.7 times of the length corresponding to a unit graduate width of the Y axis.

A ninth embodiment of the invention relates to a blast-furnace operation method in accordance with the eighth embodiment, wherein a value $\theta_x + \theta_z$ is determined according to the following relation, $$\theta_x + \theta_z = \tan^{-1}\left(\frac{1.25X - Y + 3.57}{0.7}\right) +$$

-continued $$\tan^{-1}\left(\frac{0.063Z - Y + 0.371}{0.7}\right)$$

and at least one factor among the three factors, i.e., oxygen volume(X) in blast, ore/coke(Y) and reducibility (Z) of the burden materials, is controlled so as to satisfy the relation, $$-30° \leqq \theta_x + \theta_z \leqq 30°.$$

DETAILED DESCRIPTION OF THE PREFERRED EMBODIMENTS

Figure 1:
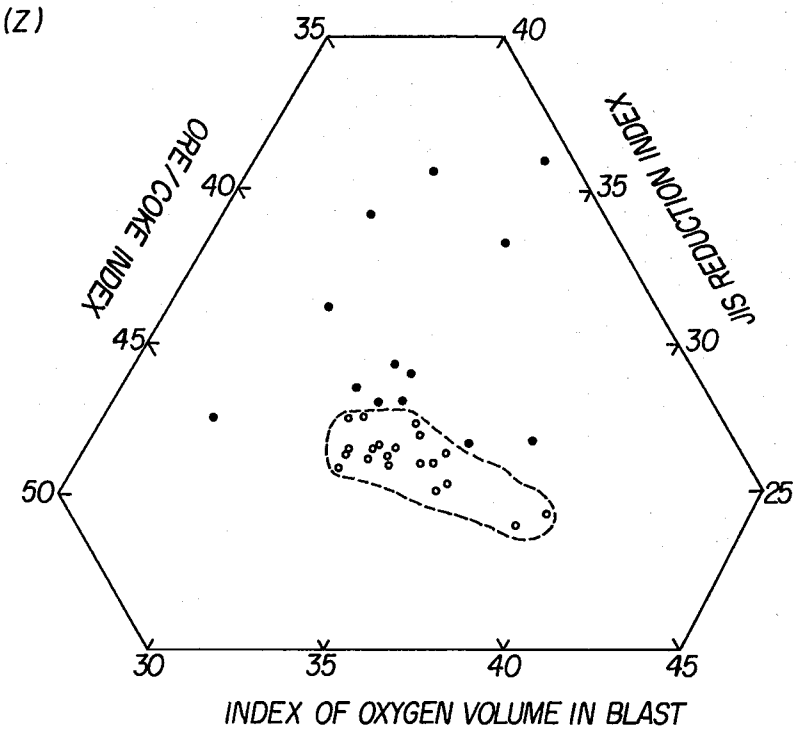
FIG. 1 is a triangular diagram showing oxygen volume in blast, ore/coke and JIS reduction ratio based on data from operation of blast furnaces in Japan.

The present invention provides a method for efficient blast-furnace operation based on three control factors, i.e. the oxygen volume (X) in the blast, the ore/coke (Y), and the reducibility (Z) of the burden materials among factors which participate in the variation of heat input and heat output of the blast furnace. In accordance with the invention, a graph is plotted wherein an axis (Y axis) which represents the ore/coke is located at the center, an axis (X axis) which represents the oxygen volume in blast and an axis (Z axis) which represents the reducibility of the burden materials are located on the left and right sides of the Y axis in parallel with each other and values of the three factors representing data of efficiently operated blast furnace are plotted on the graph. Wherein an angle $\theta$ downwardly subtended on the central axis (Y axis) by two straight lines drawn from the two points on each of the neighboring axes is determined from the plot of said data according to the relation, $$\theta = 180° + \theta_x + \theta_z \quad (1)$$

and at least one factor among the three factors is controlled according to the equation $$\theta_x + \theta_z = \tan^{-1} f(X, Y) + \tan^{-1} g(Y, Z) \quad (2)$$

-continued $$= \tan^{-1}\left(\frac{a_1X - Y + b_1}{e_1}\right) + \tan^{-1}\left(\frac{a_2Z - Y + b_2}{e_2}\right) \quad (3)$$

wherein $\theta_x$ and $\theta_z$ represent angles subtended toward the side of X axis and toward the side of Z axis with respect to a straight line drawn at right angles with the three axes passing through a value Y when the three factors are practically operating at values X, Y and Z; f(X, Y) represents a function of X and Y determined by a regression equation of X-Y obtained from the practical values of a conventional low-fuel-rate blast furnace in practical operation and a distance between the Y and Z axes; g(Y, Z) represents a function of Y and Z determined by a regression equation of Y-Z obtained from the practical values of a conventional low-fuel-rate blast furnace in practical operation and a distance between the Y and Z axes;

$a_i$(i=1, 2) represents a coefficient (gradient) of the regression equations of X-Y and Y-Z;

$b_i$(i=1, 2) represents a constant of the regression equations of X-Y and Y-Z; and $e_i$(i=1, 2) represents a constant determined by a distance between the axes X-Y and a distance between the axes Y-Z so that the value of $\theta$ for said furnace is within a suitable range of values determined from said data.

The graph consisting of three parallel axes for indicating the three factors described above is established as follows:

(i) Average values of the three factors obtained from the practical values of a conventional low-fuel-rate blast furnace in practical operation are so disposed as to serve as references of the same level on the three axes.

(ii) A ratio of unit graduate widths of the three axes is determined from the coefficients (gradients) of the following regression formulas obtained from the above mentioned practical values, $$Y = a_1X + b_1 \text{ (regression formula of X-Y)} \quad (4)$$

$$Y = a_2Z + b_2 \text{ (regression formula of Y-Z)} \quad (5)$$

For example, the ratio of unit graduate widths of axes X, Y and Z is set to be $X:Y:Z = a_1:1:a_2$.

(iii) The distance between the X axis and the Y axis and the distance between the Y axis and the Z axis are selected to be equal, or arbitrarily selected, and the distance between each of the axes is established by taking into consideration a graduate width of any one axis selected from the three axes. For example, the distances between each of the axes are set to be a predetermined number of times of the length corresponding to a unit graduate width of the Y axis.

To maintain the heat balance in a blast furnace, theoretically, all of the items related to the heat input and the heat output must be taken into consideration. The heat input includes factors such as coke combustion heat, heat content of blast, reaction heat of indirect reduction, and the like, and the heat output includes factors such as heat content of top gas, direct reduction reaction heat, heat of the pig iron and slag, heat loss from furnace surface, and the like. According to the present invention, of all of the factors related to the heat balance, only the coke combustion heat, which is the greatest controllable varying factor, is dealt with as the heat input factor, and only the direct reduction reaction heat is dealt with as the heat output factor.

The coke combustion heat, which is the heat input, is equivalent in proportion to the oxygen volume in blast, and can therefore be substituted by the oxygen volume in blast per unit furnace volume per minute utilizing a dimension of $Nm^3/min.m^3$ as a value to indicate the coke combustion heat. Further, the foregoing furnace volume of the blast furnace represents a zone for between stock-line and lower level of tap hole. In the following description, therefore, the oxygen volume in blast obtained from the operation data is employed in place of the coke combustion heat.

Further, the reaction heat of direct reduction is taken into consideration as the heat output factor because, the variations of heat of the top gas, of the pig iron and of the slag are considered to be resultant factors reflecting the excess or lack of the heat in the furnace, and the heat loss from the furnace surface is considered to be a constant which varies in proportion, to the scale of the furnace. Therefore, if these items are excluded, only the heat absorption of the direct reduction reaction serves as the greatest varying factor of heat output. The increase or decrease of the direct reduction reaction heat cannot be directly controlled, but can be indirectly controlled by controlling the indirect reduction reaction rate. That is to say, the direct reduction reaction heat can be controlled by the reducibility of ores. Reducibility may be defined as a weighted average JIS reduction ratio determined by blending ratios of ores. JIS reduction ratio refers to a final reduction ratio when 500 g of the specimen having a specified particle size is reduced with a mixture gas of 30% CO gas and 70% of $N_2$ at 900° C. for 180 minutes. The reducibility, therefore, indicates the degree of the indirect reduction reaction in the furnace by a relative value of the burden ores (relative value is indicative of the ore/coke rate in weight).

This is a conclusion derived from the statistical analysis of practical operation of the blast furnace, according to which the direct reduction ratio serves as an object variation, and the weighted average JIS reduction ratio determined by the blending ratios of ores (hereinafter simply referred to as JIS reduction ratio) and the ore/core rate in weight (hereinafter simply referred to as ore/coke) serve as illustrative variations.

A multiple correlation coefficient from the multiple regression analysis based upon the above object variation and illustrative variations is 0.883 (coefficient of determination, 0.78), thus exhibiting a very high degree of correlation. This indicates that the variation in direct reduction ratio is largely dependent upon the change of the average JIS reduction ratio of the burden materials and upon the change of ore/coke. In the present invention, ores represent all of the materials introduced into the blast furnace, such as pellets (acid pellets have an average JIS reduction ratio of about 60%, and self-fluxed pellets have an average JIS reduction ratio of about 80 to 90%), sinter (having an average JIS reduction ratio of about 55 to 70%) and lump ore (having an average JIS reduction ratio of about 30 to 70% must be taken into account).

As mentioned above, it became obvious that three factors related to the excess or lack of furnace heat should be controlled, i.e., oxygen volume in blast ($Nm^3/min.m^3$), JIS reduction ratio (%), and ore/coke. By maintaining these three factors in a balanced state, the furnace condition can be stabilized. Further, when any one of these three factors is out of balance, a suitable procedure may be promptly undertaken to restore such factor into a balanced state, thereby preventing imbalance in the furnace condition from becoming more serious. Accordingly, the inventors of the present invention have conducted intensive research in connection with interrelationship among these three factors.

In the method of the present invention, the balance among the three factors is expressed by means of a triangular diagram.

Therefore, the above three factors were plotted on a triangular diagram based upon the data of practical operation of blast furnaces throughout Japan. The results were as shown in FIG. 1. Referring to FIG. 1, a maximum value based upon the practical results of the operation of large blast furnaces in Japan is denoted by 100, the practical values are represented by way of their relative values and are so corrected that the sum of the three factors will be 100. In the diagram, open circles "O" represent annually averaged balances of three factors of excellent and stable blast furnaces in which the monthly average productivity (production amount/furnace volume per day) has never decreased below 2.0, and black circles "●" represent monthly averaged balances of the three factors one month before an accident in blast furnaces in which an accident has occurred and the monthly averaged productivity has drastically decreased. As will be obvious from the diagram, when the furnaces are efficiently operated, the three factors are balanced within a relatively narrow predetermined region designated A, whereas the three factors wherein the furnaces have developed accident or lost the condition are widely varied and therefore are not balanced. It will further be recognized that the factors not in region A are distributed toward the side of high JIS reduction ratio and low ore/coke.

Thus, the presence or absence of disturbance in the balance of three factors can be determined by means of a triangular diagram forecast and therefore it is possible to forecast an impending accident in a furnace. According to this method, however, it is not possible to clearly grasp which factor should be controlled and how in order to prevent the accident.

Figure 2:
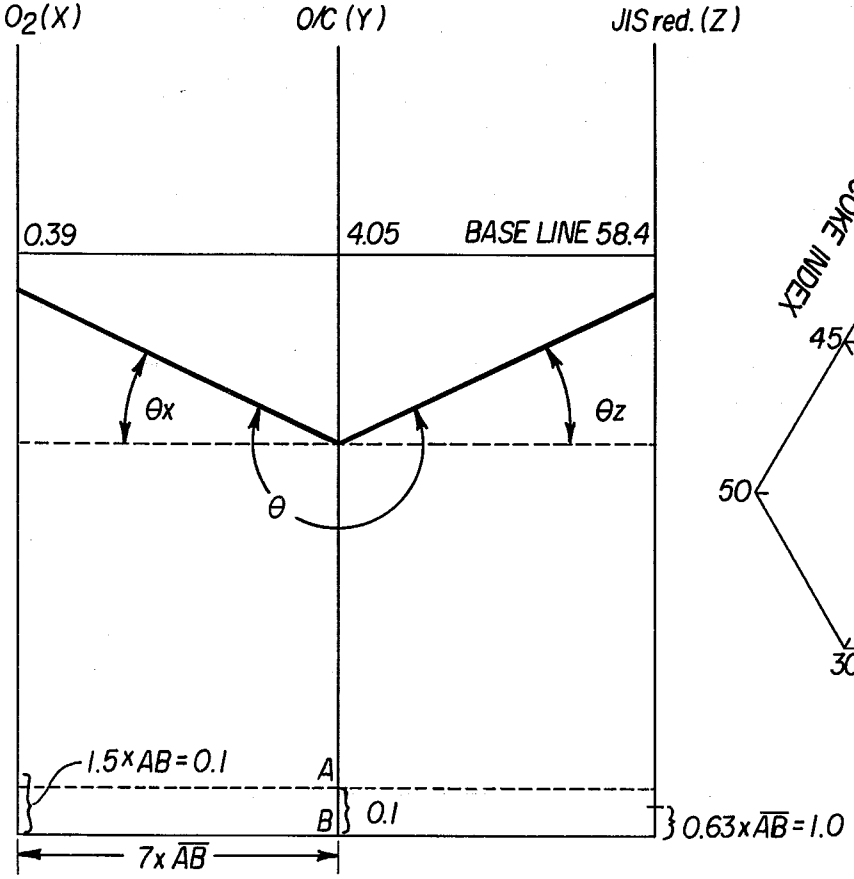
FIG. 2 is a graph showing a method of controlling three factors, i.e., oxygen volume in blast, ore/coke and JIS reduction ratio.

The inventors of the present invention have, therefore, studied the abovementioned balance of these three factors with regard to furnace conditions and have established an excellent control method which is practical for maintaining proper heat balance. In order to establish a balanced state among the three factors, the inventors of the present invention have devised a control method by way of a diagram as shown in FIG. 2 consisting of three parallel axes separated by an equal distance.

In the diagram, the axis on the left side represents oxygen volume in blast (per unit furnace volume) which is a control factor determined by taking into consideration the combustion heat of carbon in front of the tuyere, and represents the variation in heat input. Axes at the center and on the right side represent quantities that vary depending upon the heat of the direct reduction reaction and therefore serve as factors for varying the heat output. Specifically, the central axis represents an ore/coke and the axis on the right side represents an average JIS reduction ratio of the burden materials as determined from the aforementioned statistical results that the variation of the direct reduction ratio is related to the variation of ore/coke and average JIS reduction ratio. Thus, by selecting the three axes, most of the variations in heat input and heat output of the blast furnace can be represented by three controllable factors. If the values obtained from the operation data are plotted on the three axes and are connected by straight lines, there is formed a folded line downwardly directed to the central axis and meeting at an angle $\theta$. The angle $\theta$ represents the balance of three factors and serves as an indication of balance between the heat input and the heat output. To judge the condition of furnace heat depending upon the angle $\theta$, it is necessary to find a proper range of the angle $\theta$ within which it is considered that good condition of furnace heat is maintained.

Based upon the results of blast-furnace operation, therefore, a proper range of angle $\theta$ was found as mentioned below. In the following description, the oxygen volume in blast is denoted by X, the ore/coke by Y, and the JIS reduction ratio by Z.

By studying the results of large-scale blast-furnace operation recorded in Japan during 1970 to 1977, the best ten blast furnaces achieving small coke ratio in terms of annual average values were selected to examine correlations between the oxygen volume in blast (X) and the ore/coke (Y), and between the average JIS reduction ratio (Z) of the burden materials and the ore/coke (Y). As a result, the following regression lines were obtained among them. That is, a relation, $$Y=a_1X+b_1=1.25X+3.57 \quad (4)$$

between X (oxygen volume in blast) and Y (ore/coke), and a relation, $$Y=a_2Z+b_2=0.063Z+0.371 \quad (5)$$

between Z (JIS reduction ratio) and Y (ore/coke).

Figure 3:
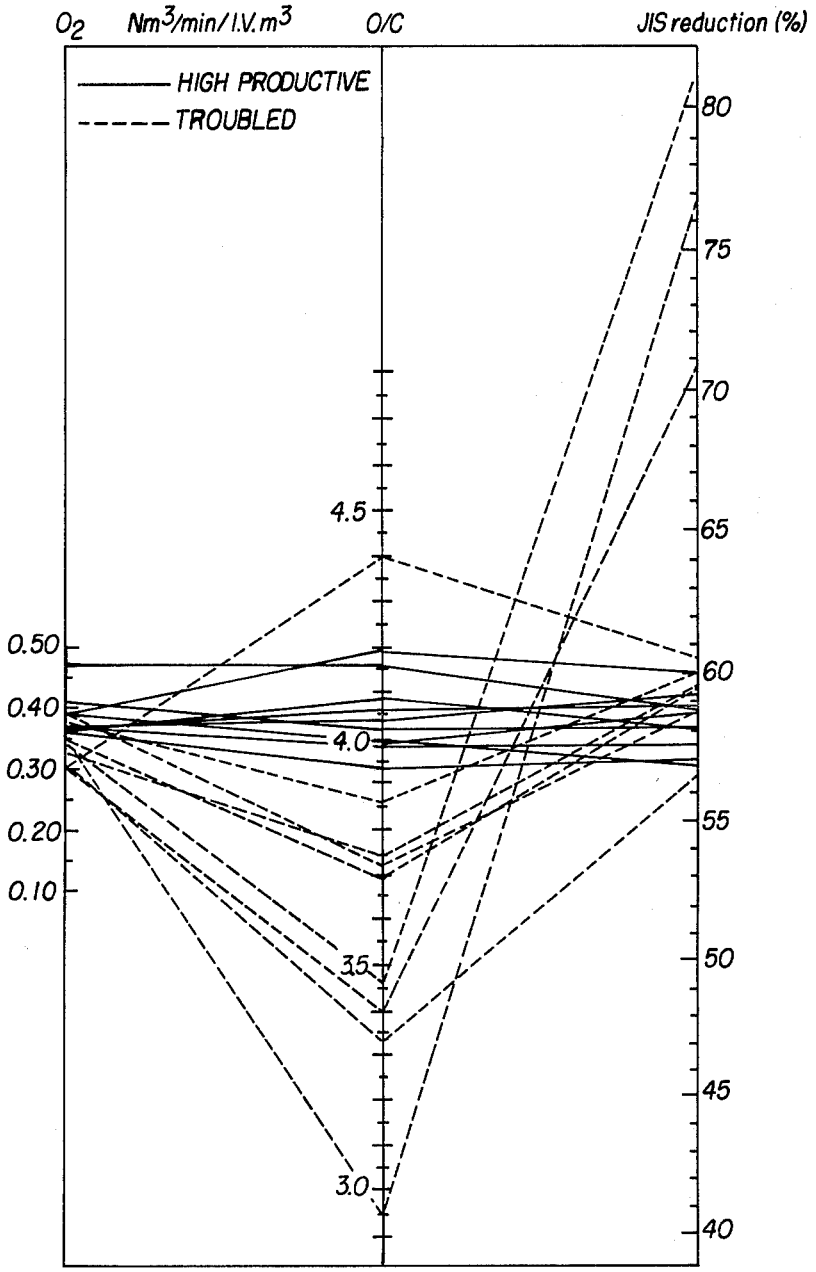
FIG. 3 is a graph showing the furnace conditions of an efficiently operating blast furnace in contrast with a blast furnace in which an accident has occured, by way of three-factor representation.

On the other hand, the average values of oxygen volume in blast (X), ore/coke (Y) and JIS reduction ratio (Z) of the ten blast furnaces are 0.39 ($Nm^3/min.m^3$), 4.05 and 58.4%. Therefore, these average values are plotted on the same level of the three axes as references, and the widths of graduates of the three axes are determined by the coefficients (gradients) of the abovementioned regression equations (1) and (2). Namely, with respect to the length ore/coke=1, the length of the X axis representing the oxygen volume in blast 1.0 $Nm^3/min.m^3$ is set to be 1.25, and the length of the Z axis corresponding to 1% of JIS reduction ratio is set to be 0.063, as shown in FIG. 3. If the distances between each of the axes is changed, it becomes difficult to specify the angle $\theta$ even if the values X, Y and Z are determined. Therefore, the distances between each of the axes must be determined by taking into consideration the width of graduate of a given axis selected from the three axes. For example, the distances between each of the axes are respectively set to e times (e: constant) of a length corresponding to a width of unit graduate of the Y axis. According to the present invention, for the purpose of convenience, the distances are set to 0.7 times of the width graduate corresponding to 1.0 on the Y axis.

The diagrams of FIG. 3 are obtained by plotting the oxygen volume in blast (X), the ore/coke (Y) and the JIS reduction ratio (Z) obtained from the data of practical operation of large-scale blast furnaces on the abovementioned graph, and connecting each of the points. Solid lines represent the conditions of blast furnaces which exhibited excellent results, and broken lines exhibit conditions of blast furnaces which developed accident. As will be obvious from FIG. 3, the excellent blast furnaces exhibit small degree of folding of lines connecting the three factors, such that diagrams approach straight lines, whereas the accident-prone blast furnaces exhibit folded lines which are sharply protruded toward the upper side or sharply recessed, thus indicating contrasting differences from the blast furnaces producing excellent results. The accident-prone blast furnaces exhibit folded lines of the convex type as represented, for example, by a plot (1), being caused by the fact that the value of ore/coke (Y) is too great or the JIS reduction ratio (Z) is too small with respect to the heat input, i.e., the oxygen volume in blast X. In this case, it is considered that the direct reduction has been excessively increased whereby the furnace heat is below the required level. If this state is left uncorrected, an accident caused by lack of heat may occur. Conversely, when the folded line tends to recess as represented, for example, by the plot (2), the ore/coke (Y) is too small with respect to the heat input (X) or the JIS reduction ratio (Z) is too great with respect thereto. In this case, it is considered that the direct reduction ratio is small and the furnace heat is in excess of the required level. If this state is left uncorrected, an accident caused by overheating may occur. On the other hand, when the degree of fold in plot is small as in the nearly straight solid lines, the furnace heat is not in excess or below the required level therefore the heat balance is properly maintained and the furnace condition is stable.

Using the digram of FIG. 3, the operating conditions of the furnace can be learned at a glance. In case the furnace heat is out of balance, correction quantities related to the control factors can be easily determined from the diagram to restore the heat balance. For instance, in FIG. 3, when the furnace condition is lack of furnace heat as represented by the plot (1), the value Y (ore/coke) should be lowered from the current value of about 4.39 to about 4.0, or the value Y should be maintained unchanged and the value (about 0.31 $Nm^3/min.m^3$) of X (oxygen volume in blast) should be raised to about 0.48 $Nm^3/min.m^3$ and the value (about 60.5%) of Z (JIS reduction ratio) should be raised to about 68.0%, thereby correcting the problem of lack of furnace heat and restoring stable furnace conditions. That is to say, to decrease the value Y, the amount of the coke should be increased or the amount of the ore should be decreased such that the balance of furnace heat falls within a suitable range. Further, to increase the Z value, materials having great JIS reduction ratios should be selected and introduced into the blast furnace. In other words, to control the Z value, the blending ratios of burden materials (pellets, sinters or lump ores) should be changed and/or the particle size of the burden materials should be changed. It is further possible to control the Z value by changing the method of firing the pellets or sinters.

The balance of three factors in stabilizing furnace conditions need not necessarily define a strictly straight line in the abovementioned diagram, but may instead define a plot folded to some extent as will be recognized from FIG. 3. If indicated by way of the angle $\theta$, the allowable degree of folding will range from 150° to 210°; i.e., a region of varience of −30° to +30° when 180° is regarded as a center of the allowable degree of folding.

Referring again to FIG. 3, the diagrams showing the furnace conditions of excellent blast furnaces are all nearly flat in the graph. Even when the drawings are upwardly or downwardly inclined toward the right, it is proper to say that the furnace heat is in a stably balanced state so far as the requirements of the above angles $\theta$ are satisfied.

As mentioned above, using the diagram of furnace conditions, it is possible to control the furnace conditions with a degree (angle $\theta$) of bending of diagram as an index.

The angle $\theta$ can be found by way of a diagram. Using a graph defining the width of graduates and distances between the axes as mentioned above, however, the angle $\theta$ can be determined by way of the following calculation.

Figure 4:
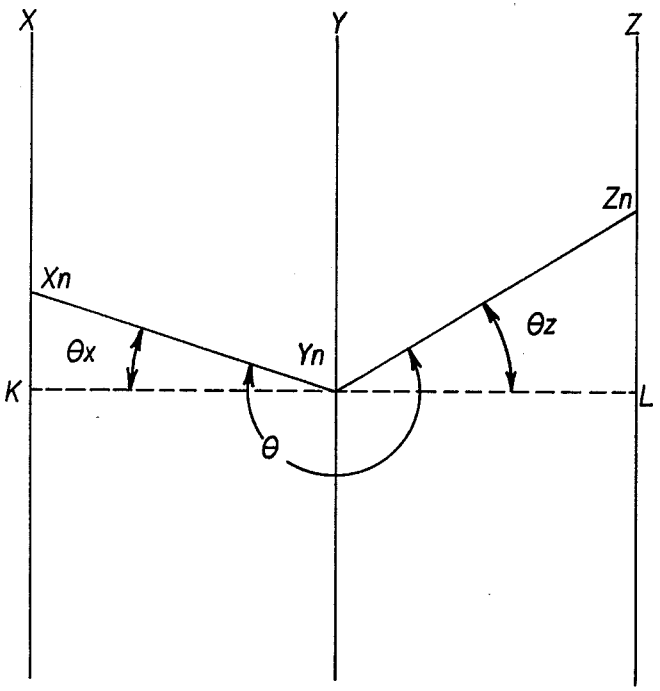

FIG. 4 shows a relationship among the three factors when the blast furnace is operated with the oxygen volume in blast, ore/coke and average JIS reduction ratio being Xn, Yn and Zn, respectively. Here, if the angle of a straight line extending toward the X axis is denoted by $\theta_x$ with respect to a straight line drawn at right angles with the three axes passing through Yn, and if the angle of a straight line extending toward the Z axis is denoted by $\theta_z$ with respect to the abovementioned straight line, the angle $\theta$ can be given by, $$\theta=\theta_x+\theta_z+180^\circ \quad (1)$$

If the angles $\theta_x$ and $\theta_z$ are denoted to be of positive (+) values when they are above a line KL and negative (−) values when they are below the line KL, the aforementioned suitable range of $\theta$, i.e., $150^\circ \leqq \theta \leqq 210^\circ$ can be written as $-30^\circ \leqq \theta_x+\theta_z \leqq +30^\circ$.

From FIG. 4, $$\theta_x = \tan^{-1}\frac{\overline{Xn \cdot K}}{\overline{K \cdot yn}}$$

$$\theta_z = \tan^{-1}\frac{\overline{Zn \cdot L}}{\overline{L \cdot Yn}}$$

Accordingly, from the aforementioned equations (4) and (5), $\theta_x+\theta_z$ can be expressed as follows:

$$\theta_x + \theta_z = \tan^{-1}f(X, Y) + \tan^{-1}g(Y, Z) \quad (2)$$

$$= \tan^{-1}\left(\frac{a_1X - Y + b_1}{e}\right) + \tan^{-1}\left(\frac{a_2Z - Y + b_2}{e}\right) \quad (3)$$

$$= \tan^{-1}\left(\frac{1.25Xn - Yn + 3.57}{0.7}\right) + \tan^{-1}\left(\frac{0.063Zn - Yn + 0.371}{0.7}\right)$$

Under the stable blast-furnace operation conditions, $\theta_x+\theta_z$ lies within a range of −30° to +30°. Therefore, to attain balanced state, the values Xn, Yn and Zn must satisfy the following relation, $$-30^\circ \leqq \tan^{-1}\frac{1.25Xn - Yn + 3.57}{0.7} + \tan^{-1}\frac{0.063Zn - Yn + 0.371}{0.7} \leqq 30^\circ \quad (6)$$

If the operation is carried out by selecting the values Xn, Yn and Zn so as to satisfy the above relation, the balance is well maintained between the heat input and the heat output, whereby the furnace conditions are stabilized to accomplish excellent results. However, there exists an actual range in which the values Xn, Yn and Zn can be practically operated. Namely, the oxygen volume in blast (X) ranges from 0.20 to 0.50 ($Nm^3/min.m^3$), the ore/coke (Y) is smaller than 4.8, and the JIS reduction ratio (Z) ranges from 40 to 90%. According to the control method contemplated by the present invention, the values X, Y and Z of the data of practical operation are inserted into the equation (6) to determine whether the range of the equation (6) is satisfied, and when the range is not satisified, the values X, Y and Z are changed so that the range of the equation (6) is satisfied. In other words, the method of the present invention is to control the three factors X, Y and Z by using the aforementioned equation (2) or the equation (3). For instance, if it is assumed that a blast furnace is operated with the oxygen volume in blast X=0.35 ($Nm^3/min.m^3$), ore/coke Y=3.5, and JIS reduction ratio Z=75%, the angles $\theta_x$ and $\theta_z$ are, $$\theta_x+\theta_z=26.6^\circ+57.9^\circ=84.5^\circ$$

which is deviated toward the positive (+) direction in view of the range of the equation (6). It is therefore concluded that the furnace heat is excessive. If the ore/coke is changed to a value of 4.3 with other conditions unchanged the calculation becomes, $$\theta_x+\theta_z=-16.7^\circ+38.5^\circ=21.8^\circ$$

which satisfies the equation (6). Therefore, the furnace can be stably operated without excess or lack of furnace heat.

Thus, using the equation (6), optimum operation factors necessary to stabilize furnace heat conditions can easily be determined. Accordingly, by programming the equation (6) to a small computer, the furnace heat can be easily controlled.

Figure 5:
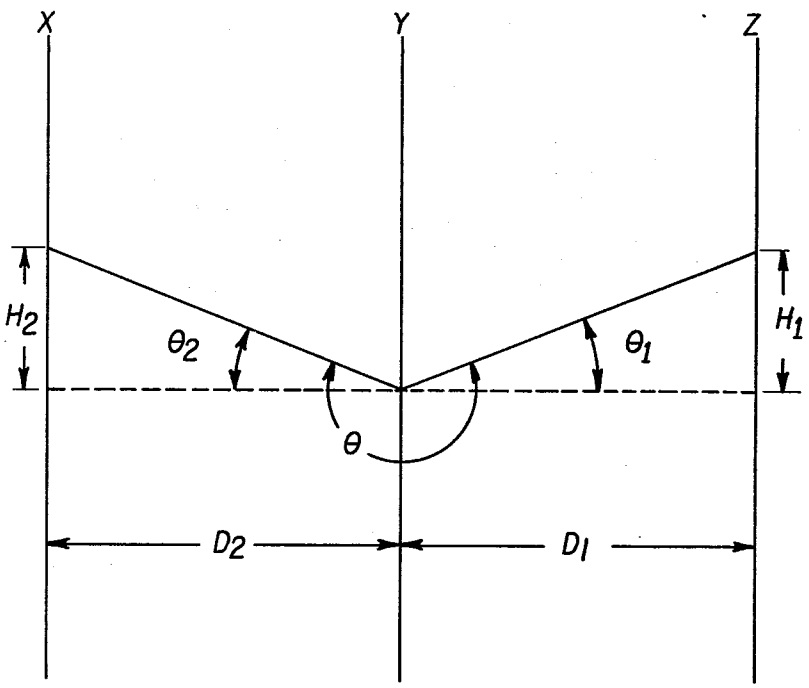
FIGS. 4 and 5 are diagrams illustrating conditions in well operated and poorly operated furnaces by way of three-factor control.

The graph of FIG. 3 can be arbitrarily prepared such that the furnace heat conditions can be determined at a glance. However, if the distances between the axes are too great, the angle $\theta$ of the diagram approaches 180° irrespective of the conditions of the furnace making it difficult to determine the actual furnace conditions. The same holds true when the distances between the axes are too short. To effectively utilize the diagram for judging the furnace condition at a glance, the distances among the three axes should desirably be set to about 3 to 10 times a length which corresponds to 0.1 of a graduate of Y axis, i.e., the distance should be set to about 0.3 to 1.0 times a length corresponding to a width of unit graduate of the Y axis. When the distance between the X axis and the Y axis, and the distance between the Y axis and the Z axis are set in accordance with arbitrary values, the angle $\theta$ of a folded line which shows a stable region of furnace conditions becomes different depending upon the thus set distances. Therefore, the upper and lower limits of the angle $\theta$ which shows the stable region should be found beforehand depending upon the distances between the axes, and the conditions of the furnace should be determined in compliance with the upper and lower limits. Specifically, when the distances between axes are denoted by $D_1$ and $D_2$ as shown in FIG. 5, the angle $\theta$ subtended by the folded line is given by, $$\theta = 180° + \theta_1 + \theta_2 \quad (7)$$

$$\theta_1 = \tan^{-1}(H_1/D_1) \quad (8)$$

$$\theta_2 = \tan^{-1}(H_2/D_2) \quad (9)$$

If the distances $D_1$ and $D_2$ are determined, the angle $\theta$ is exclusively determined with respect to the allowable limit values $H_1$ and $H_2$. Therefore, if the values $H_1$ and $H_2$ corresponding to angles (150° to 210°)which define a range of stable furnace conditions are found initially, with the distances $D_1$ and $D_2$ being set to 7 times of a length corresponding to the width 0.1 of a graduate of the Y axis (ore/coke), i.e., with the distances $D_1$ and $D_2$ being set to 0.7 times of a length corresponding to the width of a unit graduate or the Y axis as shown in FIG. 3, it is possible to find the angle $\theta$ which shows stable furnace conditions from the above equations (7) to (9) even when the distances $D_1$ and $D_2$ are arbitrarily changed, whereby it becomes possible to determine furnace conditions as well as take appropriate corrective procedures.

The method of controlling the three factors according to the present invention may also be based upon conventional data of practical operation.

Figure 6:
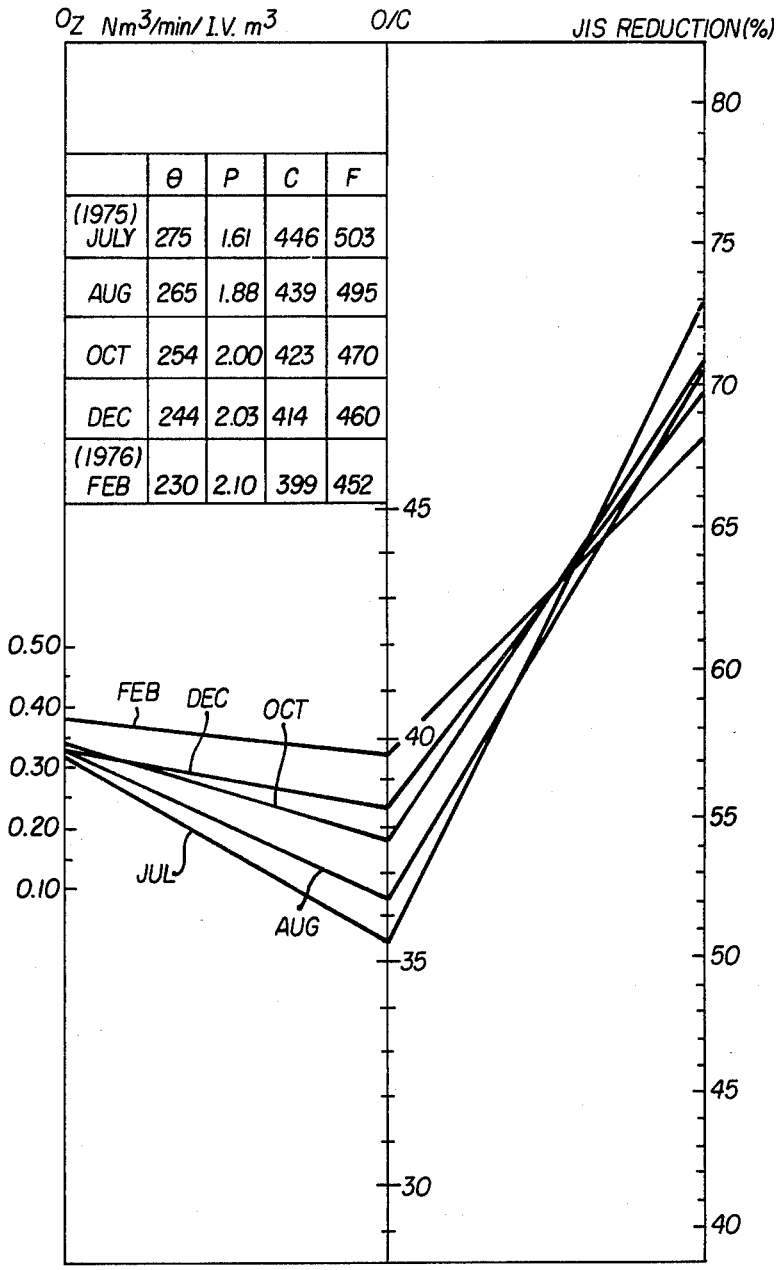
FIG. 6 is a graph showing the shift of three factors shown in FIG. 1 based upon the data of practical operation.

FIG. 6 shows the shift of monthly average values of three factors obtained from the data of practical operation of a blast furnace. In FIG. 6, the angle $\theta$ was always above 275° until July, 1975. This value was in great excess of the upper limit (210°) of the proper range. Hence, the heat input of the furnace was excessive resulting in unstable furnace conditions. The fuel rate of the furnace was as high as 503 kg/p-t, and the productivity was as low as 1.61 t/m$^3$.day. The control method of the present invention was put into effect in August, 1975. The angle $\theta$ was reduced to 230° by adjusting the ore/coke and the average JIS reduction ratio. Thus, by bringing the angle toward the proper range, the productivity and the fuel rate were markedly enhanced. However, as of February, 1976, the angle $\theta$ was 230° which was still above the proper range, necessitating further adjustment of the ore/coke and the average JIS reduction ratio. In the blast furnace represented in FIG. 6, however, the operation is carried out by charging a considerable amount of pellets into the blast furnace, which limits the adjustment of the reducibility of the burden materials. Further, since the pellets are of spherical shape, the operation at high ore/coke aggravates the permeability of gas. Moreover, the operation in a blast furnace charged with a considerable amount of pellets makes it difficult to adjust the ore/coke to a value greater than 4.0. To preclude the disadvantage inherent in the use of spherical pellets, such pellets should be crushed. By this operation, the ore/coke can be further heightened, so that the angle $\theta$ lies within the proper range.

Figure 8:
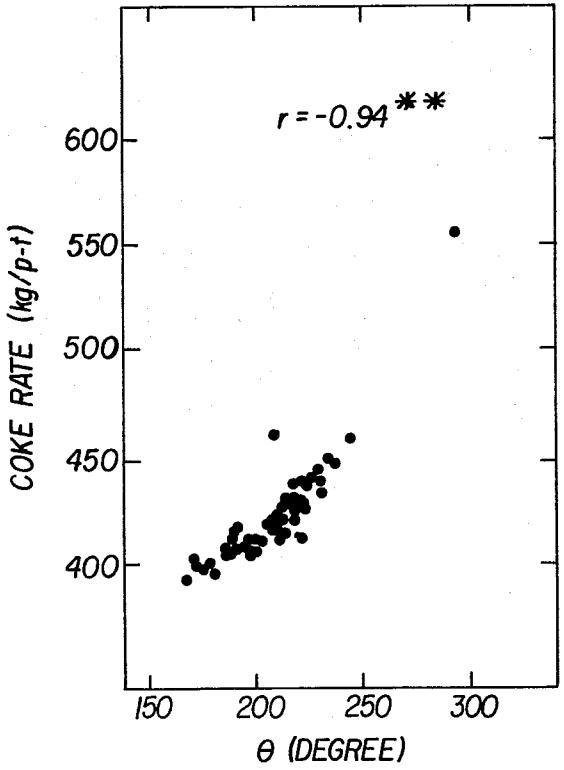
FIG. 8 is a graph showing a relation between $\theta$ and coke rate in the same blast furnace as FIG. 7.
Figure 7:
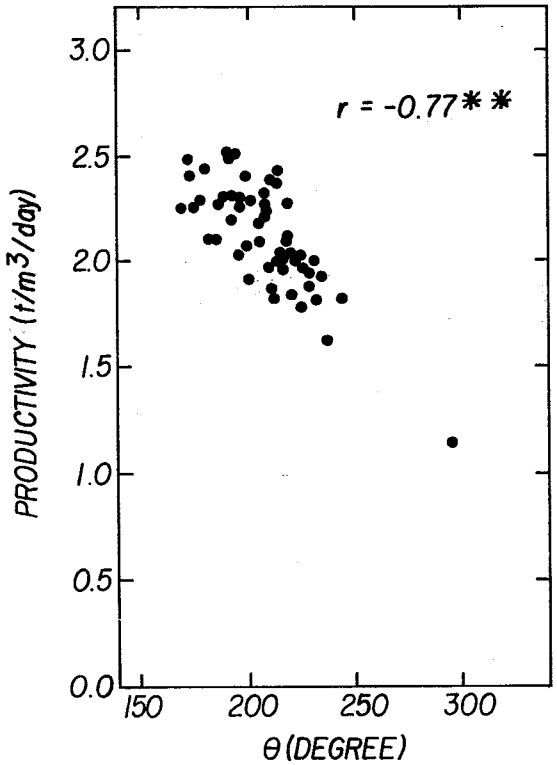
FIG. 7 is a graph showing a relation between $\theta$ and productivity in a blast furnace charged with a considerable amount of sinters.
Figure 9B:
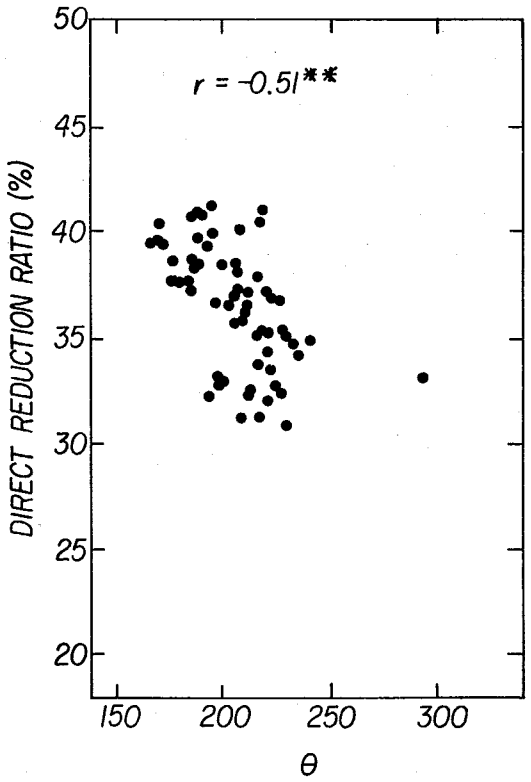
FIG. 9 is a graph showing a relation between $\theta$ and a direct reduction ratio.
Figure 9A:
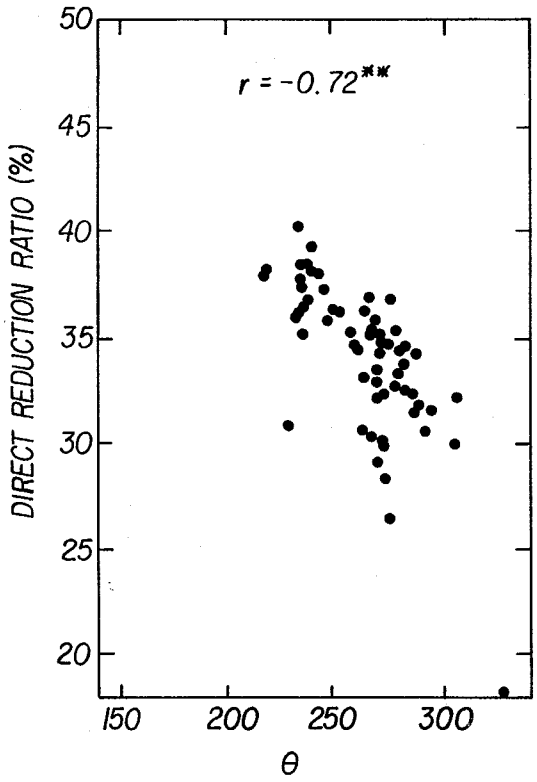

FIG. 7 shows a relation between the angle $\theta$ (monthly average value) and the productivity in a blast furnace into which are charged a considerable amount of sintered ores. It will be seen that the productivity increases as the angle $\theta$ approaches 180°. FIG. 8 shows a relation between the angle $\theta$ and the coke rate in the same blast furnace. It will be appreciated that the coke rate decreases as the angle $\theta$ approaches 180°. If the abovementioned relation between the direct reduction ratio and the angle $\theta$ in the blast furnace is investigated, it will be seen that the direct reduction ratio increases with decrease in the angle $\theta$ as shown in FIG. 9. Thus, the angle $\theta$ serves as an effective index for judging the furnace heat.

The whole world is now facing an energy crisis. Therefore, from the viewpoint of saving energy, the future trend of blast furnaces will be to minimize the fuel rate. To realize a low fuel rate, the ore/coke must be increased to be higher than 4.5 which is the highest level currently available. To achieve this purpose, it is necessary to increase the JIS reduction ratio to be greater than about 70% as will be obvious from the three-factor graph of the present invention. In this case, with blast furnaces which mainly deal with lump ores or sinters, both of which have JIS reduction ratio of less than 70%, it is likely that the furnace heat will become less than the required level due to the lack of reducibility. At present, many blast furnaces are being operated at relatively small ore/coke levels which can cause problems related to excess of heat input as shown in FIG. 3. In the future, however, it is expected that problems in blast furnace operation will, in all probability, relate to lack of heat as mentioned above. It is therefore considered that self-fluxed pellets having high reducibility will be required in the future and their use will become indispensable. As mentioned with reference to FIG. 6, however, the pellets of spherical shapes make it difficult to increase the ore/coke above 4.0. Therefore, by crushing the spherically shaped pellets, the three factors contemplated by the present invention can be easily controlled to bring the fuel rate toward the lower limit.

As mentioned above, the method of the present invention will facilitate increased utility values for operating the blast furnaces at a low fuel rate in the future.

Figure 10:
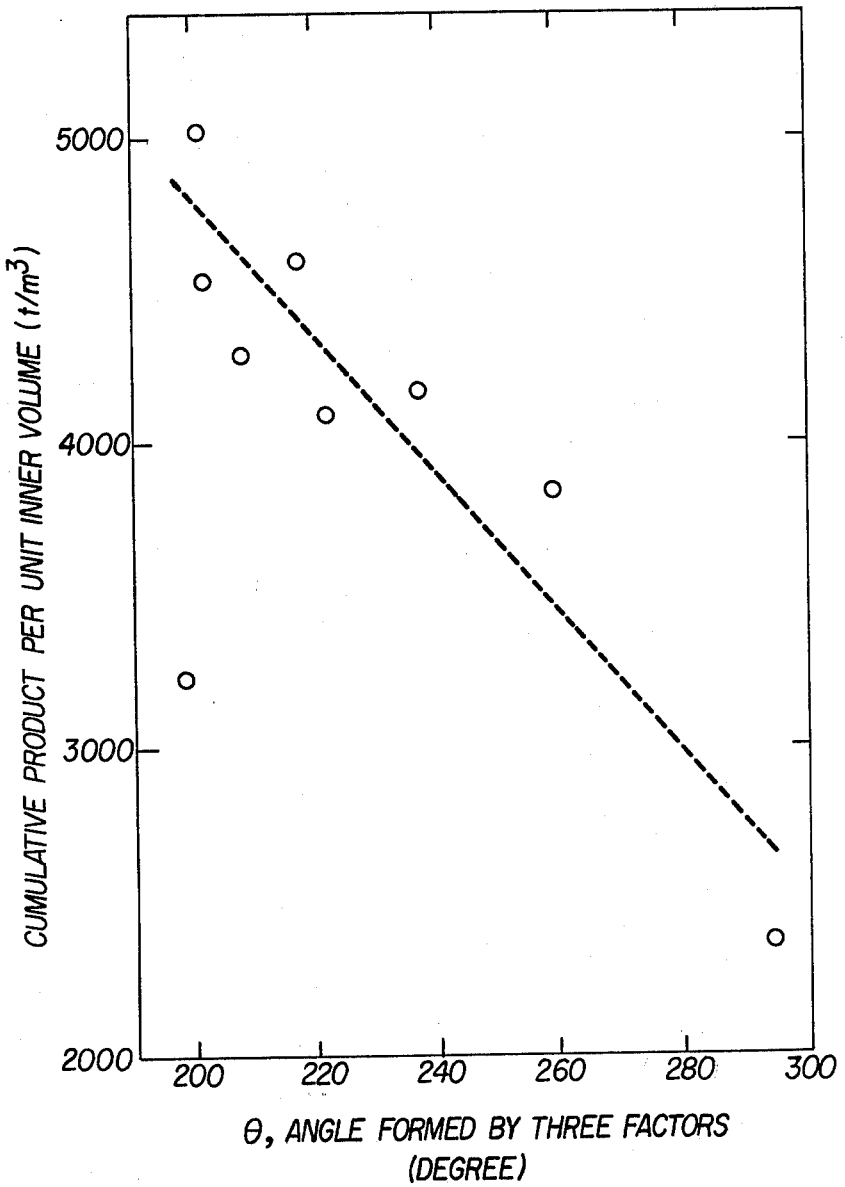
FIG. 10 is a graph showing a relation between $\theta$ and the campaign life of the blast furnace.

According to the study conducted thus far, as shown in FIG. 10, it is recognized that a strong correlation exists between the angle $\theta$ and the total amount of pig iron produced (ton/m$^3$) per unit furnace volume from the blowing-in of the blast furnace to the blowing-out. It is considered that the method of the present invention is effective in prolonging the operation life of blast furnaces. This fact gives another utility value of the method of the present invention.

What is claimed is:

1. A method for the efficient operation of a blast furnace comprising:

selecting oxygen volume in blast (x), ore/coke (Y) and reducibility of burden materials (Z) from among factors which affect heat input and heat output in the furnace; plotting a graph having a center axis (Y Axis) representing ore/coke, an axis (X axis) representing oxygen volume in blast and an axis (Z axis) representing reducibility of burden materials, the X axis and the Z axis being located in parallel on the left and right sides of the Y axis; plotting on said graph values of the three factors which represent data of efficiently operated blast furnaces; determining from the plot of the data an angle $\theta$ downwardly subtended on the central axis by straight lines drawn to the point on the central axis from the two points on the neighboring axes according to the relation $$\theta = 180° + \theta_x + \theta_z \quad (1);$$

and controlling at least one of the three factors according to the equation $$\theta_x O_z + \tan^{-1} f(X,Y) + \tan^{-1} g(Y,Z) \quad (2)$$

wherein $\theta_x$ and $O_z$ are angles subtended toward the point on the Y axis from points on the X and Z axes with respect to a straight line drawn at right angles to the three axes through a point on the Y axis wherein the points represent the operational values of the furnace, f(X,Y) represents a function of X and Y determined by a regression equation of X-Y obtained from the data of efficiently operated blast furnaces and the distance between the X and Y axes; and g(Y,Z) represents a function of Y and Z determined by a regression equation of Y-Z obtained from the data of efficiently operated blast furnaces and the distance between the Y and Z axes, so that the value of $\theta$ for the furnace is within a suitable range of values determined from the data.

2. A blast-furnace operation method according to claim 1, wherein:

$$\theta_x + \theta_z = \tan^{-1}\left(\frac{a_1X - Y + b_1}{e_1}\right) + \tan^{-1}\left(\frac{a_2Z - Y + b_2}{e_2}\right) \quad (3)$$

wherein $a_i$(i=1, or 2) represents a coefficient (gradient) of the regression equations of X-Y and Y-Z, $b_i$(i=1 or 2) represents a constant of the regression equations of X-Y and Y-Z, and $e_i$(i=1 or 2) represents a constant determined by a distance between the axes X-Y and a distance between the axes Y-Z.

3. A blast-furnace operation method according to claim 1, wherein the distances among each of the three parallel axes of the graph are equally set or arbitrarily set, average values of the three factors obtained from the data are so disposed as to serve as references of the same level on the three axes, a ratio of unit graduate widths of the three axes is determined from the coefficients (gradients) of the following regression formulas obtained from the data $$Y = a_1X + b_1 \quad (4)$$

$$Y + a_2Z + b_2 \quad (5)$$

and the distances among each of the three axes are determined by reference to a graduate width of one of them;

wherein the equation (4) is a regression equation of X-Y, and the equation (5) is a regression equation of Y-Z.

4. A blast-furnace operation method according to claim 3, wherein the ratio of unit graduate widths of the axes X, Y and Z is $X:Y:Z = a_1:1:a_2$.

5. A blast furnace operation method according to claim 3, wherein the distance between the X axis and the Y axis, and the distance between the Y axis and the Z axis are, respectively, $e_1$ times and $e_2$ times of a length corresponding to the unit graduate width of the Y axis, wherein $e_i$(i=1 or 2) represents a constant.

6. A blast-furnace operation method according to claim 5, wherein $e_i$(i=1 or 2) is 0.3 to 1.0.

7. A blast-furnace operation method according to claim 3, wherein the X axis and the Z axis are located at equal distance on the left and right sides of the Y axis, the ratio of unit graduate widths of the axes X, Y and Z is $X:Y:Z = a_1:1:a_2$, and the distance between the X axis and the Y axis and the distance between the Y axis and the Z axis are e times of a length corresponding to a unit graduate width of the Y axis, wherein e is a constant, i.e., $e = e_1 = e_2$.

8. A blast-furnace operation method according to claim 7, wherein the ratio of unit graduate widths of the axes X, Y and Z is X:Y:Z=1.25:1:0.063, and the distances between each of the axes are 0.7 times of a length corresponding to a unit graduate width of the Y axis.

9. A blast-furnace operation method according to claim 8, wherein a value $\theta_x + \theta_z$ is determined by $$\theta_x + \theta_z = \tan^{-1}\left(\frac{1.25X - Y + 3.57}{0.7}\right) + \tan^{-1}\left(\frac{0.063Z - Y + 0.371}{0.7}\right)$$

and at least one of the three factors, is so controlled as to satisfy the relation, $$-30° \leqq \theta_x\theta_z \leqq 30°.$$

* * * * *

UNITED STATES PATENT AND TRADEMARK OFFICE

CERTIFICATE OF CORRECTION

PATENT NO. : 4,273,577

DATED : June 16, 1981

INVENTOR(S) : Isao Fujita et al

It is certified that error appears in the above—identified patent and that said Letters Patent is hereby corrected as shown below:

In Figure 1, the area containing the open circles which are enclosed by the broken lines should be labelled with a letter A.

In Figure 6, the numbers describing the O/C being "30, 35, 40, and 45" should read --3.0, 3.5, 4.0, and 4.5--

In column 1, line 44, "this the reaction" should read --this reaction--

In column 2, line 3, "operate" should read --generate--

In column 2, line 64, "thre" should read --three-

In column 3, line 41, equation (1) "$\theta = 180^\circ + \theta_x + \theta_z$ tm" should read --$\theta = 180^\circ + \theta_x + \theta_z$--

In column 3, line 46, equation (2) "$\theta_x + \theta_z = \tan^{-}1f(X,Y) + \tan^{-}1g(Y,Z)$" should read --$\theta_x + \theta_z = \tan^{-1}f(X,Y) + \tan^{-1}g(Y,Z)$--

In column 3, line 63, "accordance the first" should read --accordance with the first--

In column 6, line 26, "$b_1(i = 1,2)$" should read --$b_i(i = 1,2)$--

In column 7, line 47, "core" should read --coke--

UNITED STATES PATENT AND TRADEMARK OFFICE

CERTIFICATE OF CORRECTION

PATENT NO. : 4,273,577

DATED : June 16, 1981

INVENTOR(S) : Isao Fujita et al

It is certified that error appears in the above—identified patent and that said Letters Patent is hereby corrected as shown below:

In column 14, Claim 1, line 46, "blast (x), should read --blast (X)--

In column 14, Claim 1, line 68, equation (2) "$\theta_x O_2 + \tan^{-1} f(X,Y) + \tan^{-1} g(Y,Z)$" should read --$\theta_x + \theta_z = \tan^{-1} f(X,Y) + \tan^{-1} g(Y,Z)$--

In column 15, Claim 1, line 1, "$O_z$" should read --$\theta_z$--

In column 15, Claim 3, line 41, equation (5) "$Y + a_2Z+b_2$" should read -- $Y = a_2Z + b_2$--

In column 16, Claim 9, line 44, "$-30° \leq \theta_x\theta_z \leq 30°$" should read -- $-30° \leq \theta_x + \theta_z \leq 30°$--.

Signed and Sealed this

Twentieth Day of July 1982

[SEAL]

Attest:

GERALD J. MOSSINGHOFF

Attesting Officer

Commissioner of Patents and Trademarks